US007191564B2

(12) United States Patent
Higginbotham

(10) Patent No.: US 7,191,564 B2
(45) Date of Patent: Mar. 20, 2007

(54) SELF CLEANING SHIELD

(76) Inventor: Edward A. Higginbotham, 6033 Rhonda Rd., Lynchburg, VA (US) 24502

( * ) Notice: Subject to any disclaimer, the term of this patent is extended or adjusted under 35 U.S.C. 154(b) by 319 days.

(21) Appl. No.: 10/849,913

(22) Filed: May 21, 2004

(65) Prior Publication Data

US 2005/0257432 A1 Nov. 24, 2005

(51) Int. Cl.
*E04D 13/064* (2006.01)

(52) U.S. Cl. ..... 52/12; 210/474

(58) Field of Classification Search ..... 52/12; 210/474, 477, 499

See application file for complete search history.

(56) References Cited

U.S. PATENT DOCUMENTS

| | | | | |
|---|---|---|---|---|
| 297,382 | A | 4/1884 | Golding | |
| 546,042 | A | 9/1895 | Van Horn | |
| 1,101,047 | A | 6/1914 | Yates | |
| 1,562,191 | A | 11/1925 | Reno | |
| 2,209,741 | A | 7/1940 | Sullivan | |
| 2,210,248 | A | 8/1940 | Lighthill | |
| 2,717,561 | A | 9/1955 | Bearden | |
| 2,935,954 | A | 5/1960 | Matthews | |
| 3,426,909 | A | 2/1969 | Garner | |
| 3,855,132 | A | 12/1974 | Dugan | |
| 4,727,689 | A | 3/1988 | Bosler | |
| 4,745,710 | A | 5/1988 | Davis | |
| 4,820,407 | A * | 4/1989 | Lilie | 209/397 |
| 4,841,686 | A | 6/1989 | Rees | |
| 4,937,986 | A | 7/1990 | Way, Sr. et al. | |
| 4,949,514 | A | 8/1990 | Weller | |

(Continued)

FOREIGN PATENT DOCUMENTS

| | | |
|---|---|---|
| GB | 2 351 757 A | 1/2001 |

(Continued)

*Primary Examiner*—Robert Canfield
(74) *Attorney, Agent, or Firm*—Venable LLP; Stuart I. Smith

(57) ABSTRACT

An elongated strip of extruded plastic or roll formed metal material includes a rear securing fifth plane that inserts beneath a roofing membrane of a building structure. The rear plane integrally connects to a forward extending perforated fourth plane by means of a u shaped channel, one of two u shaped channels, which additionally serve to receive and secure a lateral edge of a filtration membrane. The perforated fourth plane contains intrinsic and intersecting vertical water directing planes that extend above and beneath the surface of the fourth plane and which serve to support and contact an overlying insertable filtration membrane. The fourth plane connects to a forward extending third plane by means of a u shaped channel that serves to receive and secure a lateral edge of a filtration membrane. The third plane connects to a second plane by means of a downward extending u shaped channel. The second plane rests on the top front lip of a k-style gutter and is adjoined by a downward angled first plane that serves to disallow roof water runoff from contacting the front face of a k-style gutter. A combination of a filtration membrane configured for water permeability and debris repellency resting on vertical planes serves to break the forward flow of water, at points of contact between the vertical planes and filtration membrane, and also serves to further channel water downward through an underlying perforated plane into an underlying rain gutter. The filtration membrane is readily inserted into the u-shaped channels existing on the forward and rear edges of a perforated fourth plane.

15 Claims, 7 Drawing Sheets

U.S. PATENT DOCUMENTS

Figures 1, 2, 3:
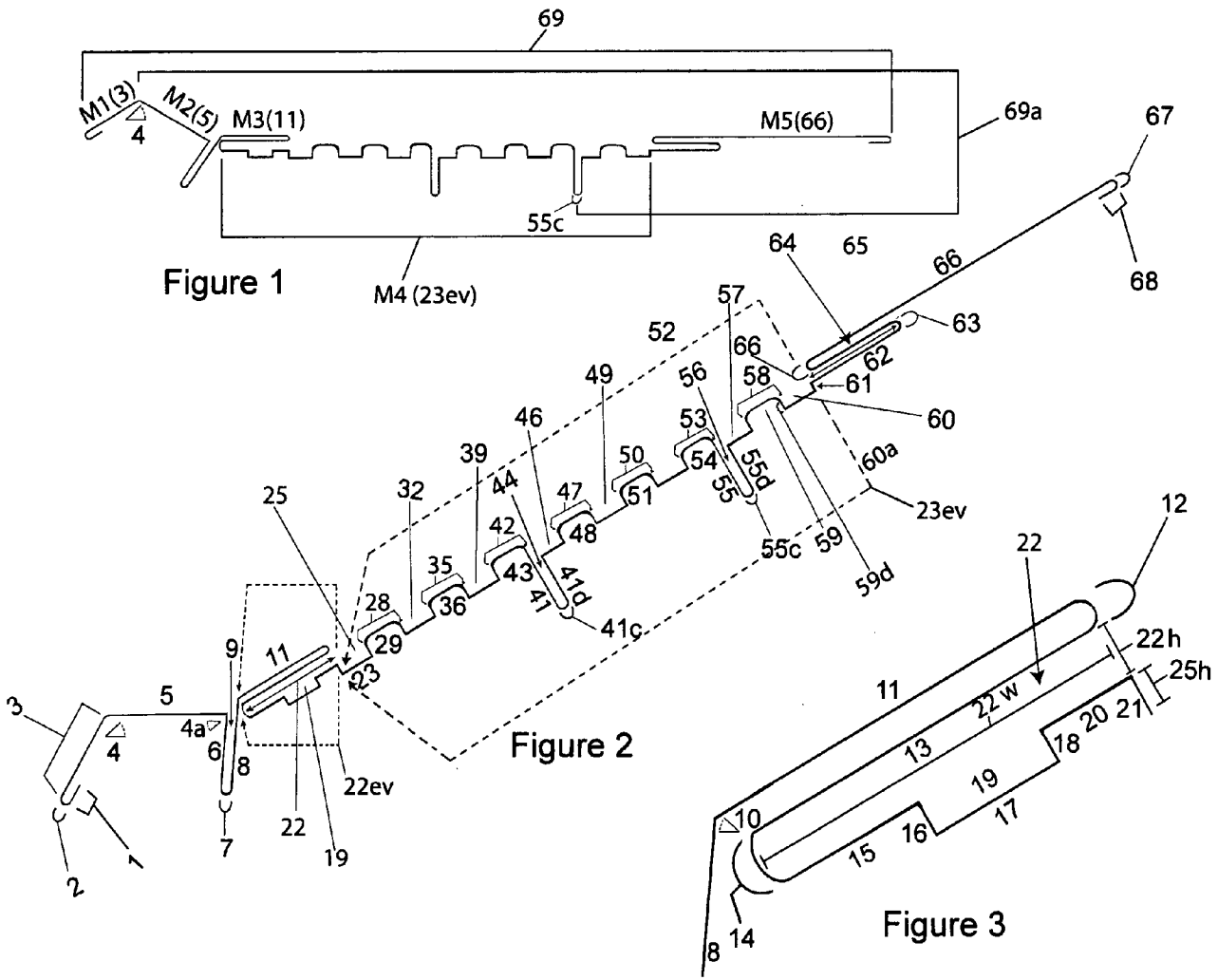

| | | | | | |
|---|---|---|---|---|---|
| 4,959,932 | A | * | 10/1990 | Pfeifer | 52/12 |
| 5,010,696 | A | | 4/1991 | Knittel | |
| 5,072,551 | A | | 12/1991 | Manoogian, Jr. | |
| 5,406,754 | A | * | 4/1995 | Cosby | 52/12 |
| 5,459,965 | A | | 10/1995 | Meckstroth | |
| 5,491,998 | A | | 2/1996 | Hansen | |
| 5,495,694 | A | | 3/1996 | Kuhns | |
| 5,555,680 | A | | 9/1996 | Sweers | |
| 5,557,891 | A | * | 9/1996 | Albracht | 52/12 |
| 5,595,027 | A | | 1/1997 | Vail | |
| 5,619,825 | A | | 4/1997 | Leroney | |
| 5,619,826 | A | | 4/1997 | Wu | |
| 5,640,809 | A | | 6/1997 | Iannelli | |
| 5,660,001 | A | | 8/1997 | Albracht | |
| 5,755,061 | A | | 5/1998 | Chen | |
| 5,813,173 | A | | 9/1998 | Way, Sr. | |
| 5,842,311 | A | | 12/1998 | Morin | |
| 5,956,904 | A | | 9/1999 | Gentry | |
| 6,016,631 | A | * | 1/2000 | Lowrie, III | 52/12 |
| 6,098,344 | A | | 8/2000 | Albracht | |
| 6,134,843 | A | | 10/2000 | Tregear | |
| 6,151,837 | A | | 11/2000 | Ealer, Sr. | |
| 6,161,338 | A | | 12/2000 | Kuhns | |
| 6,164,020 | A | | 12/2000 | Nitch | |
| 6,182,399 | B1 | | 2/2001 | Pollera | |
| 6,363,662 | B1 | | 4/2002 | Coates | |
| 6,367,743 | B1 | | 4/2002 | Iannelli | |
| 6,412,228 | B1 | | 7/2002 | Meckstroth | |
| 6,598,352 | B2 | | 7/2003 | Higginbotham | |
| 6,951,077 | B1 | * | 10/2005 | Higginbotham | 52/12 |
| 2003/0046876 | A1 | * | 3/2003 | Higginbotham | 52/11 |
| 2006/0101722 | A1 | * | 5/2006 | Ealer, Sr. | 52/12 |
| 2006/0179723 | A1 | | 8/2006 | Robins | |

FOREIGN PATENT DOCUMENTS

| | | | |
|---|---|---|---|
| JP | 1-304254 | A | 12/1989 |
| JP | 11-100953 | | 4/1999 |
| JP | 2001-349022 | A | 12/2001 |
| JP | 2002-61348 | A | 2/2002 |
| WO | WO 95/02100 | | 1/1995 |

* cited by examiner

M1(3)
M2(5)
M3(11)
M4 (23ev)
M5(66)

Figure 8
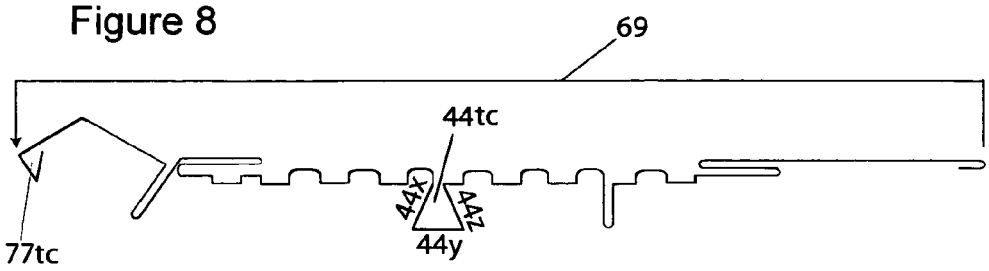
Figure 9
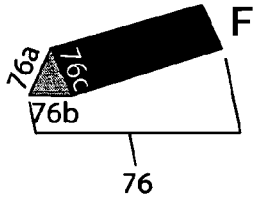
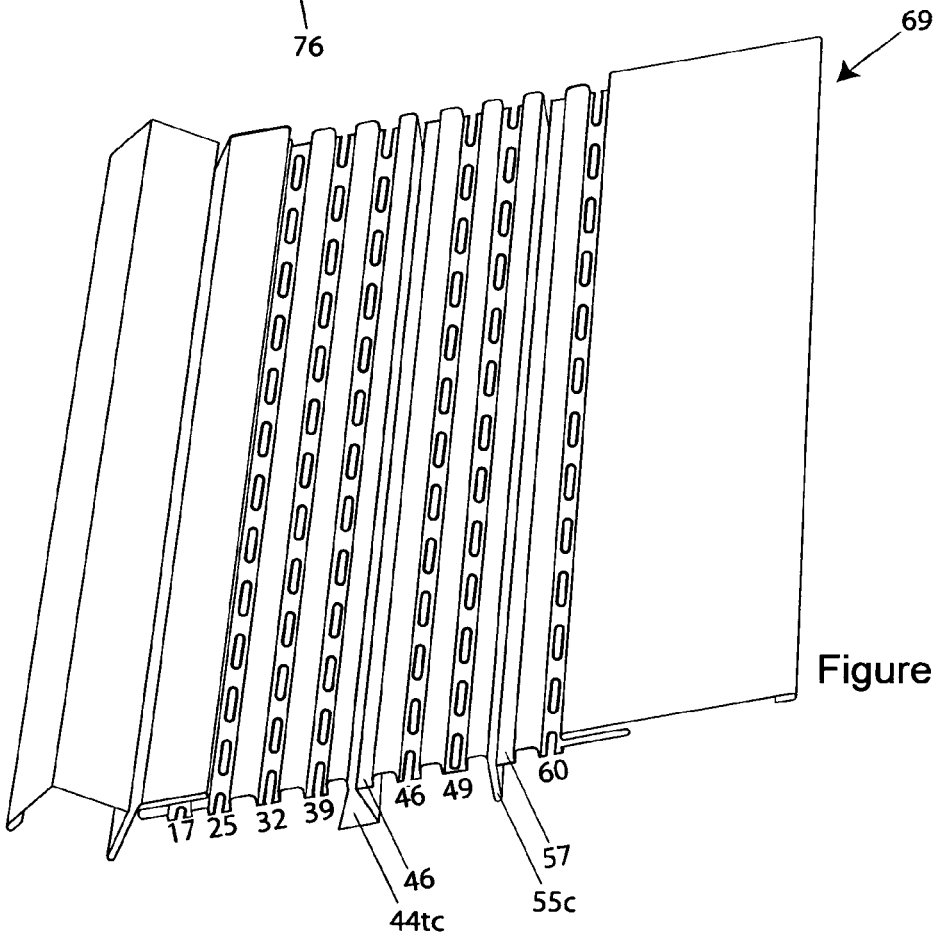
Figure 10

SELF CLEANING SHIELD

BACKGROUND

1. Field of Invention

Gutter covering systems are known to prevent debris from entering into the open top end of a rain gutter.

When debris accumulates within the body of a rain gutter in an amount great enough to cover the opening of a downspout-draining hole the draining of water from the rain gutter is impeded or completely stopped. This occurrence will cause the water to rise within the rain gutter and spill over its uppermost front and rear portions. The purpose of a rain gutter: to divert water away from the structure and foundation of a home is thereby circumvented.

2. Prior Art

The invention relates to the field of Gutter Anti-clogging Devices and particularly relates to screens with affixed fine filter membranes, and to devices that employ recessed wells or channels in which filter material may be inserted, affixed to gutters to prevent debris from impeding the desired drainage of water.

Various gutter anti-clogging devices are known in the art and some are described in issued patents.

In my U.S. Pat. No. 6,598,352 I teach a gutter protection system for preventing entrance of debris into a rain gutter. I teach a gutter protection system to include a recessed perforated angled well within a rigid main body that receives an insertable flexible polymer support skeleton that supports overlying micro mesh filtering membrane that is attached to the underlying support skeleton. This insertable flexible filtration configuration is manufactured separately from the rigid four or five foot length body in fifty foot rolls and allows for a seamless filter protecting an underlying gutter, over long gutter lengths. The insertable support skeleton includes a perforated plane with integral downward extending planes and integral upward extending support planes, separated by unbroken air space, that contact an overlying micro mesh filtering membrane on it's undermost surface. I further teach that the contacting of the undermost surface of a micromesh filtering membrane by optimally spaced support planes encourages the downward flow of rain water through said micro mesh filtering membrane and into an underlying rain gutter. This gutter protection system has been shown, in the field to be extremely effective at preventing rain gutter clogs without a single known instance of clogging. However, the insertable flexible polymer support skeleton with attached filtering membrane is somewhat heavy and has been found to be cumbersome, even impossible, to install in the recessed angled well of the rigid main body of the gutter protection system during cold weather as the flexible polymer skeleton has been found to stiffen and becomes inflexible. The insertable flexible skeleton also has been known to expand and contract at a different coefficient that rigid main body of the gutter protection system. This can cause areas of the main body of the gutter protection to become exposed to potential debris entrance due to relative shrinkage of the insertable polymer support skeleton or, in other instances, the insertable filtration configuration may expand and extend past the main body of the gutter protection system and further expand past end caps of an underlying gutter which home owners view as undesirable from a cosmetic perspective.

U.S. Pat. No. 5,557,891 to Albracht teaches a gutter protection system for preventing entrance of debris into a rain gutter. Albracht teaches a gutter protection system to include a single continuous two sided well with angled sides and perforated bottom shelf 9 into which rainwater will flow and empty into the rain gutter below. The well is of a depth, which is capable of receiving a filter mesh material. However, attempts to insert or cover such open channels of "reverse-curve" devices with filter meshes or cloths is known to prevent rainwater from entering the water receiving channels. This occurrence exists because of the tendency of such membranes, (unsupported by a proper skeletal structure), to channel water, by means of water adhesion along the interconnected paths existing in the filter membranes (and in the enclosures they may be contained by or in), past the intended water-receiving channel and to the ground. This occurrence also exists because of the tendency of filter mediums of any present known design or structure to quickly waterproof or clog when inserted into such channels creating even greater channeling of rainwater forward into a spill past an underlying rain gutter. Filtering of such open, recessed, channels existing in Albracht's invention as well as in U.S. Pat. No. 5,010,696, to Knittel, U.S. Pat. No. 2,672,832 to Goetz, U.S. Pat. Nos. 5,459,350, & 5,181,350 to Meckstroth, U.S. Pat. No. 5,491,998 to Hansen, U.S. Pat. No. 4,757,649 to Vahldieck and in similar "reverse-curved" inventions that rely on "reverse-curved" surfaces channeling water into an open channel have been known to disallow entrance of rainwater into the water-receiving channels. Albracht's as well as previous and succeeding similar inventions have therefore notably avoided the utilization of filter insertions. What may appear as a logical anticipation by such inventions at first glance, (inserting of a filter mesh or material into the channel), has been shown to be undesirable and ineffective across a broad spectrum of filtering materials: Employing insertable filters into such inventions has not been found to be a simple matter of anticipation, or design choice of filter medium by those skilled in the arts. Rather, it has proved to be an ineffective option, with any known filter medium, when attempted in the field. Such attempts, in the field, have demonstrated that the filter mediums will eventually require manual cleaning. German Patent 5,905,961 teaches a gutter protection system for preventing the entrance of debris into a rain gutter. The German patent teaches a gutter protection system to include a single continuous two sided well 7 with angled sides and perforated bottom shelf which rainwater will flow and empty into the rain gutter below. The well is recessed beneath and between two solid lateral same plane shelves close to the front of the system for water passage near and nearly level with the front top lip of the gutter. The well is of a depth, which is capable of receiving a filter mesh material. However, for the reasons described in the preceding paragraphs, an ability to attach a medium to an invention, not specifically designed to utilize such a medium, may not result in an effective anticipation by an invention. Rather, the result may be a diminishing of the invention and its improvements as is the case in Albracht's patent U.S. Pat. No. 5,557,891, the German Patent, and similar inventions employing recessed wells or channels between adjoining planes or curvatures.

U.S. Pat. No. 5,595,027 to Vail teaches a continuous opening 24A between the two top shelves. Vail teaches a gutter protection system having a single continuous well 25, the well having a depth allowing insertion and retention of filter mesh material 26 (a top portion of the filler mesh material capable of being fully exposed at the holes). Vail does teach a gutter protection system designed to incorporate an insertable filter material into a recessed well. However, Vail notably names and intends the filter medium to be a tangled mesh fiberglass five times the thickness of the invention body. This type of filtration medium, also claimed in U.S. Pat. No. 4,841,686 to Rees, and in prior art currently marketed as FLOW-FREE. TM.

is known to trap and hold debris within itself which, by design, most filter mediums are intended to do, i.e.: trap and hold debris. Vail's invention does initially prevent some debris from entering an underlying rain gutter but gradually becomes ineffective at channeling water into a rain gutter due to the propensity of their claimed filter mediums to clog with debris. Though Vail's invention embodies an insertable filter, such filter is not readily accessible for cleaning when such cleaning is necessitated. The gutter cover must be removed and uplifted for cleaning and, the filter medium is not easily and readily inserted replaced into its longitudinal containing channel extending three or more feet. It is often noted, in the field, that these and similar inventions hold fast pine needles in great numbers which presents an unsightly appearance as well as create debris dams behind the upwardly extended and trapped pine needles. Such filter meshes and non-woven lofty fiber mesh materials, even when composed of finer micro-porous materials, additionally tend to clog and fill with oak tassels and other smaller organic debris because they are not resting, by design, on a skeletal structure that encourages greater water flow through its overlying filter membrane than exists when such filter meshes or membranes contact planar continuously-connected surfaces. Known filter mediums of larger openings tend to trap and hold debris. Known filter mediums smaller openings clog or "heal over" with pollen and dirt that becomes embedded and remains in the finer micro-porous filter mediums. At present, there has not been found, as a matter of common knowledge or anticipation, an effective water-permeable, non-clogging "medium-of-choice" that can be chosen, in lieu of claimed or illustrated filter mediums in prior art, that is able to overcome the inherent tendencies of any known filter mediums to clog when applied to or inserted within the types of water receiving wells and channels noted in prior art. Vail also discloses that filter mesh material 26 is recessed beneath a planar surface that utilizes perforations in the plane to direct water to the filter medium beneath. Such perforated planar surfaces as utilized by Vail, by Sweers U.S. Pat. No. 5,555,680, by Morin U.S. Pat. No. 5,842,311 and by similar prior art are known to only be partially effective at channeling water downward through the open apertures rather than forward across the body of the invention and to the ground. This occurs because of the principal of water adhesion: rainwater tends to flow around perforations as much as downward through them, and miss the rain gutter entirely. Also, in observing perforated planes such as utilized by Vail and similar inventions (where rainwater experiences its first contact with a perforated plane) it is apparent that they present much surface area impervious to downward water flow disallowing such inventions from receiving much of the rainwater contacting them. A simple design choice or anticipation of multiplying the perforations can result in a weakened body subject to deformity when exposed to the weight of snow and/or debris or when, in the case of polymer bodies, exposed to summer temperatures and sunlight.

U.S. Pat. No. 4,841,686 to Rees teaches an improvement for rain gutters comprising a filter attachment, which is constructed to fit over the open end of a gutter. The filter attachment comprised an elongated screen to the underside of which is clamped a fibrous material such as fiberglass. Rees teaches in the Background of The Invention that many devices, such as slotted or perforated metal sheets, or screens of wire or other material, or plastic foam, have been used in prior art to cover the open tops of gutters to filter out foreign material. He states that success with such devices has been limited because small debris and pine needles still may enter through them into a rain gutter and clog its downspout opening and or lodge in and clog the devices themselves. Rees teaches that his use of a finer opening tangled fiberglass filter sandwiched between two lateral screens will eliminate such clogging of the device by smaller debris. However, in practice it is known that such devices as is disclosed by Rees are only partially effective at shedding debris while channeling rainwater into an underlying gutter. Shingle oil leaching off of certain roof coverings, pollen, dust, dirt, and other fine debris are known to "heal over" such devices clogging and/or effectively "water-proofing" them and necessitate the manual cleaning they seek to eliminate. (If not because of the larger debris, because of the fine debris and pollutants). Additionally, again as with other prior art that seeks to employ filter medium screening of debris; the filter medium utilized by Rees rests on an inter-connected planar surface which provides non-broken continuous paths over and under which water will flow, by means of water adhesion, to the front of a gutter and spill to the ground rather than drop downward into an underlying rain gutter. Whether filter medium is "sandwiched" between perforated planes or screens as in Rees' invention, or such filter medium exists below perforated planes or screens and is contained in a well or channel, water will tend to flow forward along continuous paths through cur as well as downward into an underlying rain gutter achieving less than desirable water-channeling into a rain gutter.

U.S. Pat. No 5,956,904 to Gentry teaches a first fine screen having mesh openings affixed to an underlying screen of larger openings. Both screens are elastically deformable to permit a user to compress the invention for insertion into a rain gutter. Gentry, as Rees, recognizes the inability of prior art to prevent entrance of finer debris into a rain gutter, and Gentry, as Rees, relies on a much finer screen mesh than is employed by prior art to achieve prevention of finer debris entrance into a rain gutter. In both the Gentry and Rees prior art, and their improvements over less effective filter mediums of previous prior art, it becomes apparent that anticipation of improved filter medium or configurations is not viewed as a matter of simple anticipation of prior art which has, or could, employ filter medium. It becomes apparent that improved filtering methods may be viewed as patenable unique inventions in and of themselves and not necessarily an anticipation or matter of design choice of a better filter medium or method being applied to or substituted within prior art that does or could employ filter medium. However, though Rees and Gentry did achieve finer filtration over filter medium utilized in prior art, their inventions also exhibit a tendency to channel water past an underlying gutter and/or to heal over with finer dirt, pollen, and other pollutants and clog thereby requiring manual cleaning. Additionally, when filter medium is applied to or rested upon planar perforated or screen meshed surfaces, there is a notable tendency for the underlying perforated plane or screen to channel water past the gutter where it will then spill to the ground. It has also been noted that prior art listed herein exhibits a tendency to allow filter cloth mediums to sag into the opening of their underlying supporting structures. To compensate for forward channeling of water, prior art embodies open apertures spaced too distantly, or allows the apertures themselves to encompass too large an area, thereby allowing the sagging of overlying filter membranes and cloths. Such sagging creates pockets wherein debris tends to settle and enmesh.

U.S. Pat. No. 3,855,132 to Dugan teaches a porous solid material which is installed in the gutter to form an upper barrier surface (against debris entrance into a rain gutter). Though Dugan anticipates that any debris gathered on the upper barrier surface will dry and blow away, that is not always the case with this or similar devices. In practice, such devices are known to "heal over" with pollen, oil, and other pollutants and effectively waterproof or clog the device rendering it ineffective in that they prevent both debris and water from entering a rain gutter. Pollen may actually cement debris to the top surface of such devices and fail to allow wash-off even after repeated rains. U.S. Pat. No. 4,949,514 to Weller sought to present more water receiving top surface of a similar solid porous device by undulating the top surface but, in fact, effectively created debris "traps" with the peak and valley undulation. As with other prior art, such devices may work effectively for a period of time but tend to eventually channel water past a rain gutter, due to eventual clogging of the device itself.

There are several commercial filtering products designed to prevent foreign matter buildup in gutters. For example the FLOW-FREE.TM gutter protection system sold by DCI of Clifton Heights, Pa. Comprises a 0.75-inch thick nylon mesh material designed to fit within 5-inch K type gutters to seal the gutters and downspout systems from debris and snow buildup. The FLOW-FREE. TM device fits over the hanging brackets of the gutters and one side extends to the bottom of the gutter to prevent the collapse into the gutter. However, as in other filtering attempts, shingle material and pine needles can become trapped in the coarse nylon mesh and must be periodically cleaned.

U.S. Pat. No. 6,134,843 to Tregear teaches a gutter device that has an elongated matting having a plurality of open cones arranged in transverse and longitudinal rows, the base of the cones defining a lower first plane and the apexes of the cones defining an upper second plane. Although the Tregear device overcomes the eventual trapping of larger debris within a filtering mesh composed of fabric sufficiently smooth to prevent the trapping of debris he notes in prior art, the Tregear device tends to eventually allow pollen, oil which may leach from asphalt shingles, oak tassels, and finer seeds and debris to coat and heal over a top-most matting screen it employs to disallow larger debris from becoming entangled in the larger aperatured filtering medium it covers. Tregear indicates that filtered configurations such as a commercially available attic ventilation system known as Roll Vent. TM. manufactured by Benjamin Obdyke, Inc. Warminster, Pa. Is suitable, with modifications that accommodate its fitting into a rain gutter. However, such a device has been noted, even in its original intended application, to require cleaning (as do most attic screens and filters) to remove dust, dirt, and pollen that combine with moisture to form adhesive coatings that can scum or heal over such attic filters. Filtering mediums (exhibiting tightly woven, knitted, or tangled mesh threads to achieve density or "smoothness") employed by Tregear and other prior art have been unable to achieve imperviousness to waterproofing and clogging effects caused by a healing or pasting over of such surfaces by pollen, fine dirt, scum, oils, and air and water pollutants. Additionally, referring again to Tregear's device, a lower first plane tends to channel water toward the front lip of a rain gutter, rather than allowing it's free passage downward, and allow the feeding and spilling of water up and over the front lip of a rain gutter by means of water-adhesion channels created in the lower first plane.

Prior art has employed filter cloths over underlying mesh, screens, cones, longitudinal rods, however such prior art has eventually been realized as unable to prevent an eventual clogging of their finer filtering membranes by pollen, dirt, oak tassels, and finer debris. Such prior art has been noted to succumb to eventual clogging by the healing over of debris which adheres itself to surfaces when intermingled with organic oils, oily pollen, and shingle oil that act as an adhesive. The hoped for cleaning of leaves, pine needles, seed pods and other debris by water flow or wind, envisioned by Tregear and other prior art, is often not realized due to their adherence to surfaces by pollen, oils, pollutants, and silica dusts and water mists. The cleaning of adhesive oils, fine dirt, and particularly of the scum and paste formed by pollen and silica dust (common in many soil types) by flowing water or wind is almost never realized in prior art.

Prior art that has relied on reverse curved surfaces channeling water inside a rain gutter due to surface tension, of varied configurations and pluralities, arranged longitudinally, have been noted to lose their surface tension feature as pollen, oil, scum, Eventually adhere to them. Additionally, multi-channeled embodiments of longitudinal reverse curve prior art have been noted to allow their water receiving channels to become packed with pine needles, oak tassels, other debris, and eventually clog disallowing the free passage of water into a rain gutter. Examples of such prior art are seen in the commercial product GUTTER HELMET.RTM. manufactured by American metal products and sold by Mr. Fix It of Richmond, Va. In this and similar Commercial products, dirt and mildew build up on the bull-nose of the curve preventing water from entering the gutter. Also ENGLERT'S LEAFGUARD. RTM. Manufactured and entering the gutter. Also ENGLERT'S LEAFGUARD. RTM. Manufactured and distributed by Englert Inc. of Perthamboy N.J. and K-GUARD. RTM. Manufactured and distributed by KNUDSON INC. of Colorado are similarly noted to lose their water-channeling properties due to dirt buildup. These commercial products state such, in literature to homeowners that advises them on the proper method of cleaning and maintaining their products.

With the exception of U.S. Pat. No. 6,598,352, none of these above-described systems keep all debris out of a gutter system allowing water alone to enter, for an extended length of time. Some allow lodging and embedding of pine needles and other debris is able to occur within their open water receiving areas causing them to channel water past a rain gutter. Others allow such debris to enter and clog a rain gutter's downspout opening. Still others, particularly those employing filter membranes, succumb to a paste and or scum-like healing over and clogging of their filtration membranes over time rendering them unable to channel water into a rain gutter. Pollen and silica dirt, particularly, are noted to cement even larger debris to the filter, screen, mesh, perforated opening, and/or reverse curved surfaces of prior art, adhering debris to prior art in a manner that was not envisioned. My earlier patent has proven effective but may exhibit undesirable cosmetic features and may prove difficult, even impossible, to install under certain cold weather conditions.

Accordingly, it is an object of the present invention to provide a gutter shield that employs the effective properties of my U.S. Pat. No. 6,598,352: a gutter shield device that employs a fine filtration combination that is not subject to gumming or healing over by pollen, silica dust, oils, and other very fine debris, a gutter shield device that provides a filtration configuration and encompassing body that eliminates any forward channeling of rain water, a gutter shield that will accept more water run-off into a five inch K-style rain gutter than such a gutter's downspout opening is able to drain before allowing the rain gutter to overflow (in instances where a single three-inch by five-inch downspout is installed to service 600 square feet of roofing surface).

Another object of the present invention is to provide a gutter shield with the above noted properties that incorporates and makes integral within it's main rigid body the features and structure of the insertable flexible polymer support skeleton disclosed in my U.S. Pat. No. 6,598,352 thereby eliminating the most prominent expansion and contraction coefficients found to exist between a rigid main body utilizing an insertable flexible polymer filtration configuration.

Another object of the present invention is to provide a gutter shield with the above noted properties that utilizes a stainless steel or aluminum micromesh filter cloth that may be inserted into a main body with integral recessed and perforated wells that incorporate integral upward extending planes allowing for a lower cost of manufacture by eliminating a separately manufactured flexible polymer support skeleton and allowing for a lighter, more stable under varying temperatures, and more easily installed insertable filtering component.

Another object of the present invention is to provide a gutter shield that employs a filtration membrane that is readily accessible and easily replaceable if such membrane is damaged by nature or accident.

Other objects will appear hereinafter.

SUMMARY

It has now been discovered that the above and other objects of the present invention may be accomplished in the following manner. Specifically, the present invention provides a gutter shield for use with gutters having an elongated opening. Normally the gutters are attached to or suspended from a building.

The gutter shield device comprises an extruded polymer or roll formed metallic uni-body of an angled first plane that extends outward from the front top lip of a rain gutter and that adjoins a second horizontal plane that rests on the top front lip of a rain gutter.

The second plane adjoins a third plane, that angles upward, by means of a downward extending u-shaped channel that exists on the underside of the rear edge of said second plane.

The first plane, second plane, and downward extending u-shaped channel serve as a front fastening configuration that secures the forward most area of the main body of the present invention to the top front lip of a k style rain gutter.

The third upward angled plane adjoins, by means of a second u-shaped channel that is present beneath and parallel to it, a fourth multi-leveled perforated plane that is parallel to and below the third plane. The second u-shaped channel serves as a receiving channel for the lateral edge of a filtration membrane. A portion of the fourth plane that lies parallel and directly beneath the third plane serves as a wall of the receiving channel.

The fourth plane is perforated and contains intrinsic multiple vertical planes that intersect the fourth plane rising upward and downward. These vertical planes serve to break the forward flow of water over and through a filtration membrane and direct it downward onto themselves at the points of contact existing between the vertical planes and the underside of the filtration membrane. The intersecting vertical planes existing in the fourth plane further direct water flow downward through the perforations of the underlying fourth plane into an underlying rain gutter.

The fourth plane adjoins a fifth plane by means of a third u shaped channel. The third u shaped channel serves as a receiving channel for the lateral edge of a filtration membrane.

The fifth plane is parallel to and above the fourth plane and serves as a rear securing member of the present invention that inserts beneath a roofing membrane of a building structure.

A filtration configuration is inserted in receiving channels present in the body of the gutter shield device. The filter configuration is comprised of small stainless steel or aluminum wire threads that are crimp woven into a wire cloth that contains a minimum of 100 wire threads per square inch which exhibit open air spaces of less than or equal to 100 microns between threads.

The gutter shield body may be inserted into and secured in a rain gutter by common methods now recognized as public domain. The filtration configuration is slid into u-shaped receiving channels. The receiving channels secure and position the filtration configuration to contact upward extending planes present in plane four.

OBJECTS AND ADVANTAGES

An object of the present invention is to provide a gutter shield device that exhibits properties disclosed in U.S. Pat. No. 6,598,352 titled "Self Cleaning Gutter Shield". These properties include:

1. employing a fine filtration combination that is not subject to gumming or healing over by pollen, silica dust, oils, and other very fine debris
2. providing a filtration configuration that prevents the entrance of debris larger than 100 microns from entering any area of a k-style gutter
3. providing a filtration configuration that eliminates the forward channeling of water past an underlying rain gutter to a greater degree than has been exhibited in prior art
4. providing a filtration configuration that remains water permeable and water directing regardless of the type or amount of organic debris that may rest upon it Another object of the present invention is to provide the above listed properties in an embodiment that incorporates an insertable skeletal structure that is separate from the main gutter shield body, disclosed in U.S. Pat. No. 6,598,352, into the main body of the present invention. This will lessen product weight, material and shipping costs, eliminate a secondary manufacturing step of sewing filtration membrane to a separate insertable skeletal structure, and allow for a more readily installed gutter shield.

Another object of the present invention is to provide the above listed properties, previously accomplished in part by utilizing polymer warp-knit fabrics, in a more stable filtration membrane. This is accomplished in the present invention by utilizing a metallic crimp-woven cloth that is less subject to decomposition while exhibiting similar properties to those noted in the filtration medium disclosed in U.S. Pat. No. 6,598,352.

THE DRAWINGS

FIG. 1. is a sectional edge view displaying the profile of the main body of the present invention as it would appear extruding from a roll forming machine or plastic extrusion die.

FIG. 2. is a sectional edge view displaying the profile of the main body of the present invention enlarged 150%.

FIG. 3. is an isolated view of the profile of the main body of the present invention enlarged 400%.

Figure 3A:
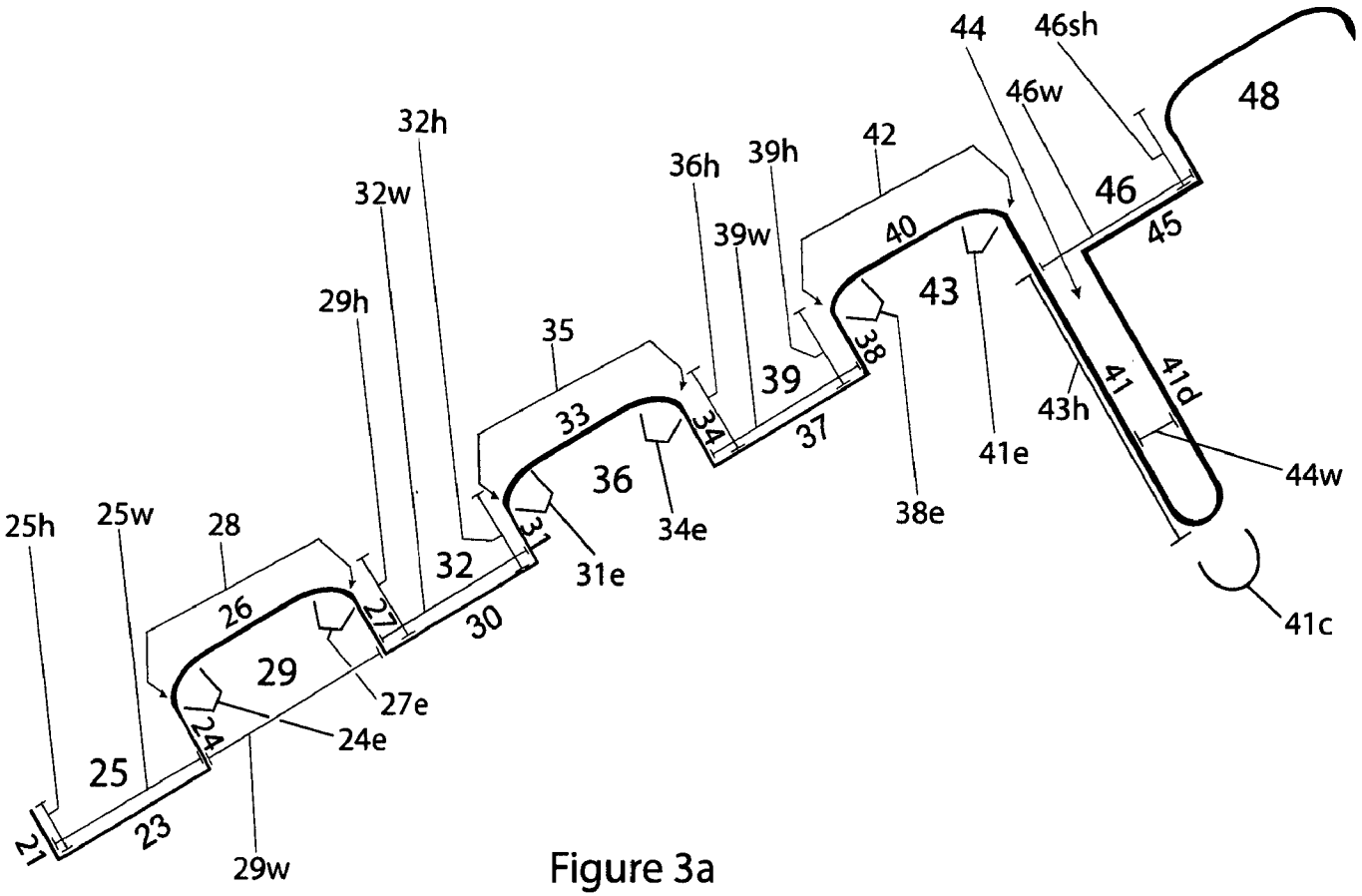

FIG. 3*a*. is an isolated view of the profile of the main body of the present invention enlarged 400%.

Figure 4:
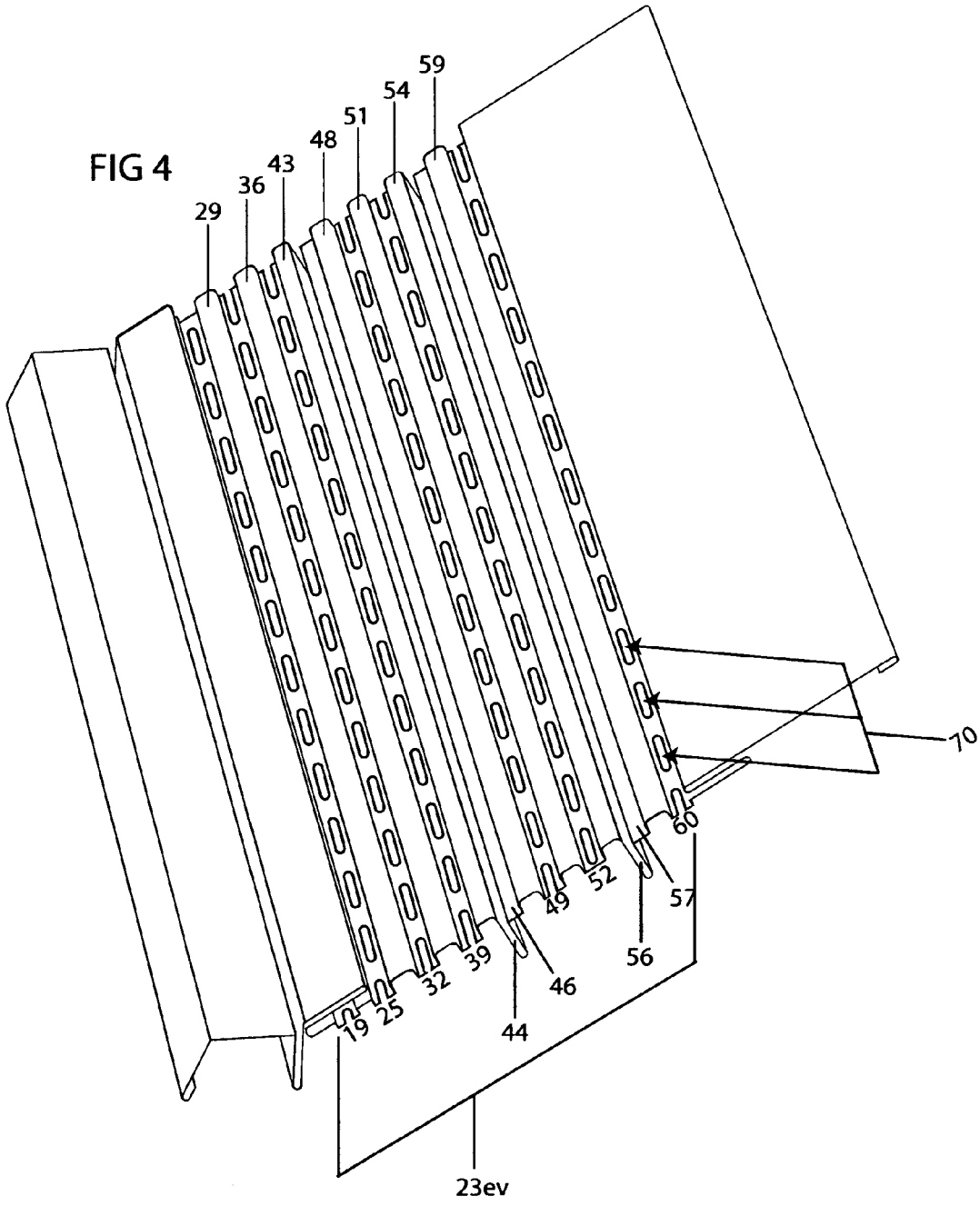

FIG. 4. is a partial top perspective view of the main body of the present invention.

Figure 5:
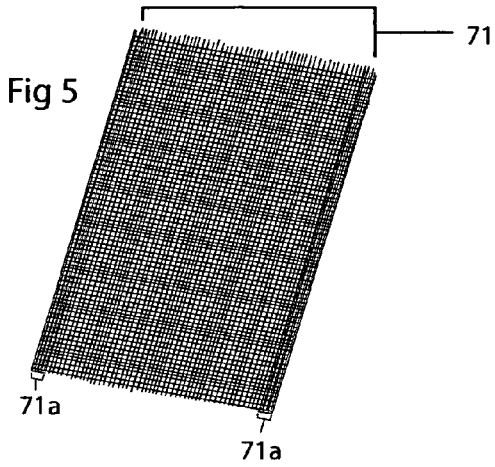

FIG. 5. is an isolated view of a filter medium which affixes to the main body of the present invention or which is inserted into filter medium receiving channels of the present invention.

Figure 5A:
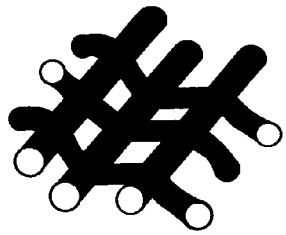
Figure 6:
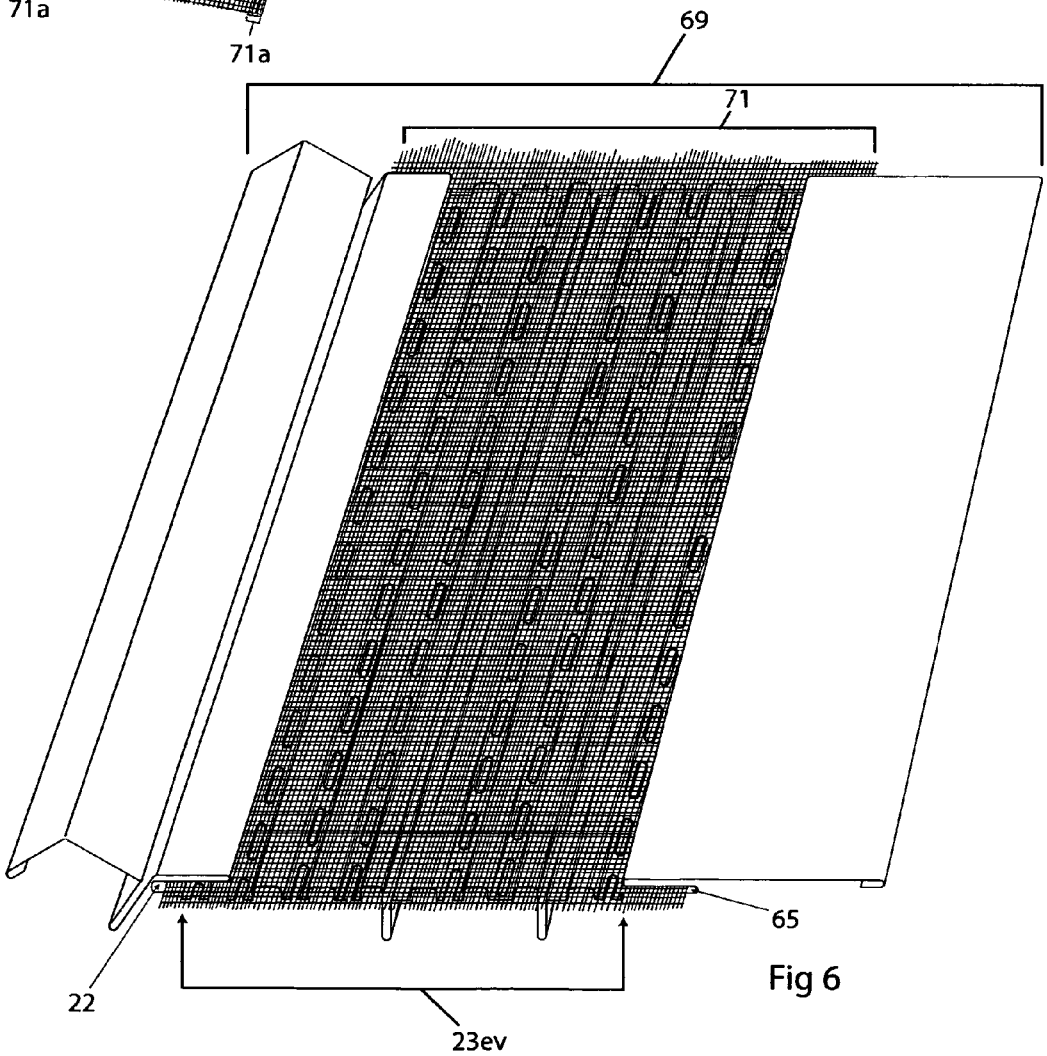

FIG. 5*a*. is an isolated and exploded view of the filter medium FIG. 6. is a partial top perspective view of the preferred embodiment of the present invention displaying the main body of the gutter cover with inserted filter medium.

Figure 7:
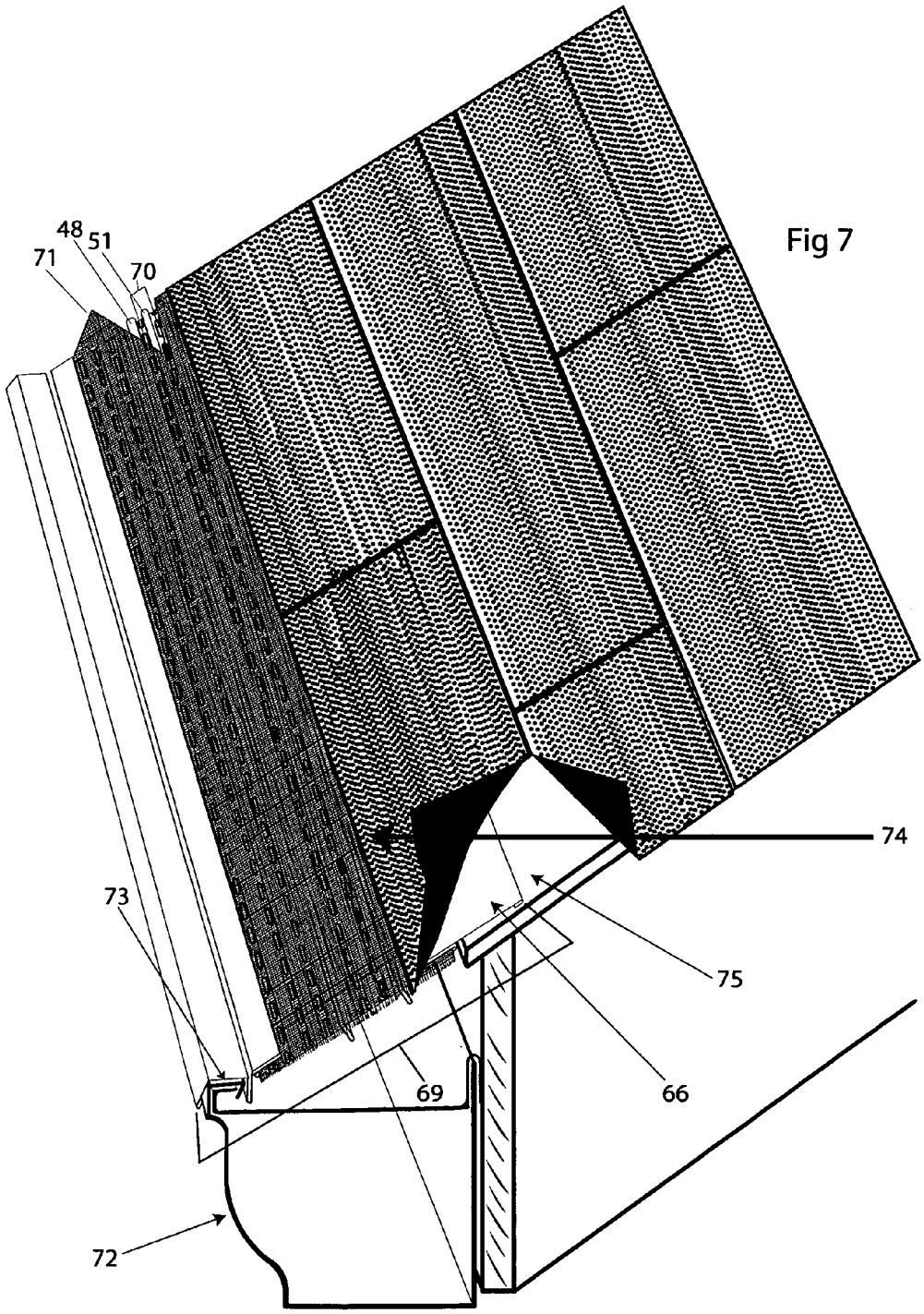

FIG. 7. is a partial top perspective view of the present invention, reduced 45%, displaying a roofline portion of a building structure, roof shingles, K-style gutter, and attached gutter cover.

FIG. 8. is a sectional edge view displaying an alternate embodiment of the profile of the main body of the present invention as it would appear extruding from a roll forming machine or plastic extrusion die.

FIG. 9. is a partial top perspective view of an optional joining member that may be inserted into an alternate embodiment of the main body of the present invention.

FIG. 10. is a partial top perspective view of an alternate embodiment of the main body of the present invention.

Figure 11:
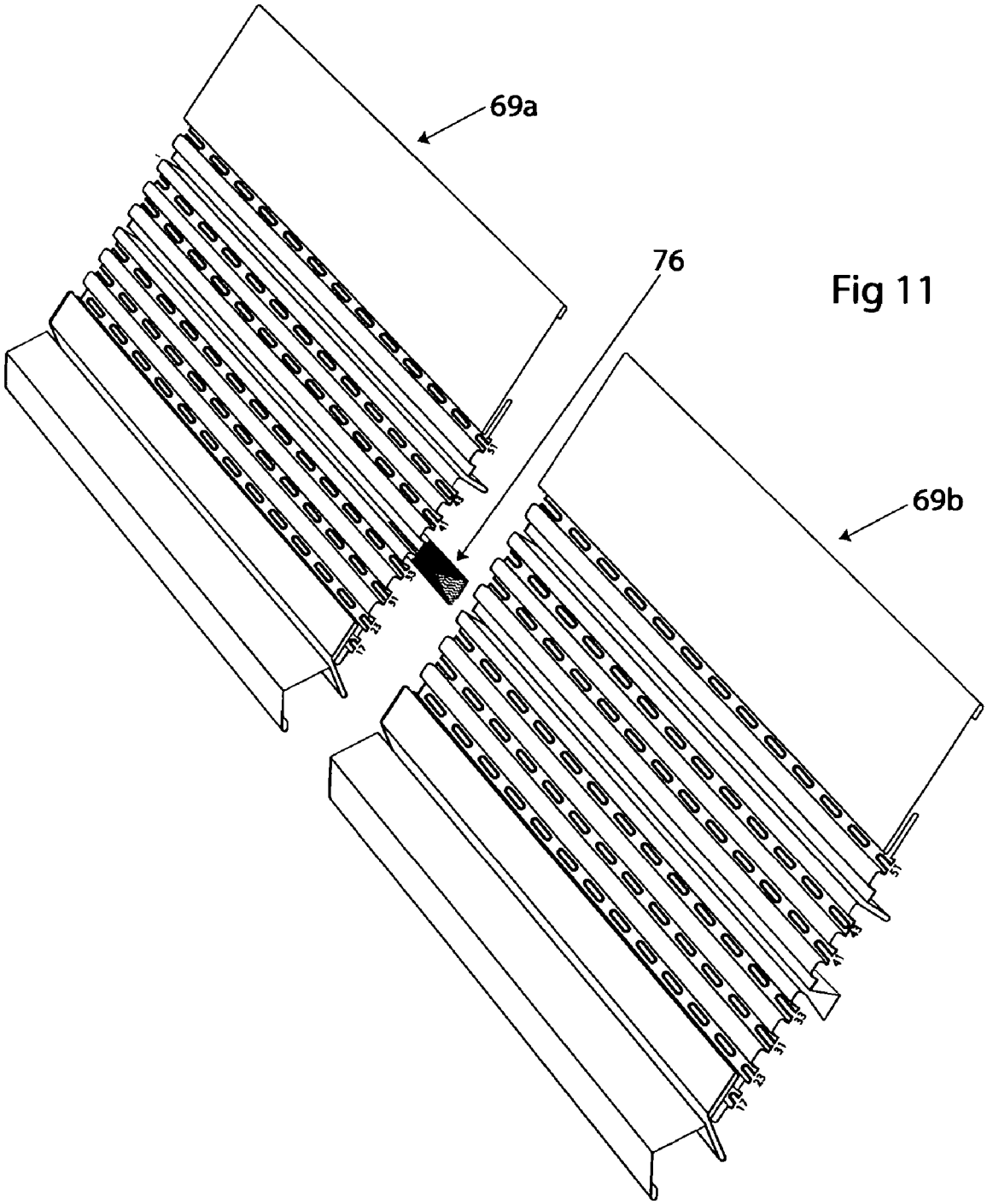

FIG. 11. is a partial top perspective view displaying a joining member inserted into an alternate embodiment of the main body of the present invention prior to being joined to a second section of gutter cover.

DESCRIPTION OF THE PREFERRED EMBODIMENT

Sub-Heading 1

Main Body

Referring now specifically to the drawings, a gutter cover (protector) body 69 with intrinsic with an insertable metallic micro mesh filtering membrane 71 is illustrated in FIG. 6.

69, as a polymer body, is composed of poly vinyl chloride (PVC) that is reduced to liquid form through screw compression of PVC "tags". This liquid plastic mixture is then extruded through a profile forming die, then through a cooling tray and cut to 5 foot lengths. The extruded body material is rigid and has a thickness of approximately 0.06 inch. The extruded body 69 has intrinsic channels 22 and 65 that receive an insertable 120 "thread count" stainless steel wire cloth 71 with hemmed lateral edges and having a width of 3 and ⅝ inches. 69, as a metallic body is roll-formed from 0.019 to 0.027 aluminum coil slit to widths of 11¾ inches and greater; depending on the width of gutter the present invention is to installed upon.

Referring to FIG. 1, a profile of the main body 69 of the present invention is illustrated having five major interconnected planes, M1(3), M2(5), M3(11), M4(23*ev*), M5(66) with a width that may vary between 5.4 and 7 inches (illustrated at 5.4 inches wide) and a height 69*a*, measured from the lowest point of channel 55*c* to the uppermost point of angle 4, of approximately 0.67 inch.

Sub-Heading 1a

Front Fastening Member

Referring to FIG. 2, plane 1 is extruded or roll formed to a length of approximately 0.11 inch. Adjoining plane 1 is circumference 2 which is extruded or roll formed to an outside diameter of approximately 0.06 inch. Adjoining circumference 2 is plane 3 having a length of approximately 0.53 inch. Plane 3 adjoins and angles 4 approximately 60 degrees downward from horizontal plane 5. Plane 5 has an approximate length of 0.5 inch and extrudes or roll forms downward at an approximate 96 degree angle 4*a* to form downward extending plane or channel 9 which is formed by plane 6, circumference 7, and plane 8.

In its roll formed metallic state, 6, 7, and 8, form a downward extending u-shaped channel 9 with an open air space existing between planes 6 and 8 of approximately 0.022 inch. In its roll formed metallic state, plane 6 has a length of approximately 0.49 inch, plane 8 has a length of approximately 0.42 inch and circumference 7 has an outside diameter of approximately 0.06 inch. When the present invention is formed as an extruded polymer product, 9 is non-existent and planes 6 and 8 are combined integrally and may be thought of as singular plane 6/8 with 7 existing as a termination of the downward extension of 9.

The combination of 1, 2, 3, 4, 5, 6, 7, 8, 9 of the present invention in its roll formed metallic state, or the combination of 1, 2, 3, 4, 5, 6/8, 7 of the present invention in its extruded polymer state, forms a front fastening member of the present invention that secures it to the top front lip of a k-style gutter.

Sub-Heading 1b

First Filtration Membrane Receiving Channel

Referring to FIG. 3, which is an exploded view of FIG. 2:22*ev*, plane 11 adjoins and angles rearward (toward the rear of the present invention) and upward from plane 8 approximately 30 degrees forming an angle 10 between planes 8 and 11 of approximately 60 degrees. Plane 11 has an approximate length of 0.44 inch. Plane 11, in a roll formed metallic embodiment of the present invention, adjoins circumference 12 which curves downward into plane 13 that lies directly beneath and parallel to plane 11. In this roll formed metallic state, plane circumference 12 has an approximate outside diameter of 0.06 inch. and plane 13 has an approximate length of 0.44 inch. When the present invention is formed as an extruded polymer product plane 11 and plane 13 combine integrally and may be thought of as singular plane 11/13 with 11 being the topmost surface and 13 the undersurface of 11/13 and circumference 12 exists as a termination point rather than as a circumference. 13, as a separate plane in the metallic roll formed state of the present invention, adjoins downward curving circumference 14. Similarly, 11/13, as a singular plane in the extruded polymer state of the present invention, adjoins downward curving circumference 14.

Circumference 14 has an outside diameter of approximately 0.075 and adjoins plane 15 which is parallel to plane 13 (or plane 11/13). Plane 15 has an approximate length of 0.17 inch. Plane 15 adjoins plane 16 which has an approximate length of 0.045 inch and angles downward approximately 90 degrees from plane 15. Plane 16 angles rightward and upward at an approximate 90 degree angle and adjoins plane 17. Plane 17 has an approximate length of 0.157 inch and adjoins upward angling plane 18 at an approximate 90 degrees. Plane 18 has an approximate length of 0.045 inch and adjoins plane 20 at an approximate 90 degree angle. Plane 20 has an approximate length of 0.10 inch. Planes 16, 17, and 18 form a recessed well 19 shown to serve as a perforated water receiving well in FIG. 4:17.

Plane 11, circumference 12, plane 13 (or plane 11/13), circumference 14, planes 15, 16, 17, 18, and 20 form a u-shaped receiving channel 22 with an approximate width 22*w* of 0.48 inch and an approximate height 22*h* of 0.056 measured from 13 to 20 This receiving channel is illustrated and referred to, collectively, as 22 as illustrated in FIG. 6:22. FIG. 6 further illustrates that the present invention employs a second receiving channel 6:65 that serves, with 6:62 to receive and secure filtering membrane 6:71. The structure and dimensions of receiving channel 65 are illustrated later in this disclosure.

Sub-Heading 1c

Multilevel Water Receiving Area

FIG. 2:22*ev* illustrates a multilevel water receiving area of the present invention. Referring to FIG. 3*a*, which is an exploded view of a portion of FIG. 2: 23*ev*, plane 20 is formed or extruded at an approximate 90 degree downward angle into plane 21. Plane 21 has an approximate length of 0.045 inch and is extruded or roll formed rearward into plane 23. Plane 23 is perforated, as is illustrated in FIG. 4:70 with elliptical perforations approximately 0.09 in wide, 0.38 inches long, and spaced longitudinally at approximately 0.15 inch intervals. As a profiled illustration, plane 23 has an approximate length of 0.154 inch and is extruded or roll formed upward at an approximate 90 degree angle into plane 24. Plane 24 is roll formed or extruded upward approximately 0.045 inch then further roll formed or extruded into partial ellipse 24*e*. Planes 21, 23, 24 jointly form a water receiving perforated well or channel 25, (further illustrated in FIG. 4:23), that has an approximate height 25*h* of 0.06 inch and an approximate interior width 25*w* of 0.15 inch. measured from the inner wall of plane 21 to the inner wall of plane 24.

Partial ellipse 24*e* has an approximate partial circumference of 0.03 inch. Partial ellipse 24*e* is roll formed or extruded into plane 26 which, if extended, parallels plane 23. Plane 26 has an approximate length of 0.076 inch. and is roll formed or extruded downward into partial ellipse 27*e*. Partial ellipse 24*e*, plane 26, and plane 27*e* jointly form an ellipsed cap 28 that contacts the underside of an overlying filtration membrane 64 (as illustrated in FIG. 6). Ellipsed cap 28 has an approximate length of 0.16 inch measured from the initial point of partial ellipse 24*e*, through plane 26, to the termination point of partial ellipse 27*e*. Partial ellipse 27*e* is roll formed or extruded downward into plane 27 which parallels plane 24. Plane 27 has an approximate length of 0.045 inch.

Sub-Heading 1c1

Water Directing Bumps

Referring again to FIG. 3*a*: plane 24, partial ellipse 24*e*, plane 26, partial ellipse 27*e*, and plane 27 jointly form a "bump" 29 that extends upward and supports and contacts the underside of an overlying filtration membrane 71, (as illustrated in FIG. 6) that rests on the ellipsed cap 28 integral to bump 29. Bump 29 has an approximate height 29*h* of 0.068 inch and an approximate width 29*w* of 0.13 inch.

Referring again to FIG. 2 and FIG. 3*a*, "Bumps" 36, 43, 48, 51,and 59 and their respective integral caps 35, 42, 47, 50, and 58 existent in the multi-level water receiving well of the present invention have measurements identical to bump 29 and its respective integral cap 28 as illustrated in FIG. 3*a*.

Referring again to both FIG. 2 and FIG. 3*a*, Bumps 43 and 54 with their respective integral caps 42 and 53 also have measurements identical to bump 29 and its respective integral cap 28 with the exception of their rear most downward extending legs 41 and 55 respectively. These legs each have an approximate length of 0.25 inch and serve to form a wall of downward extending channels 44 and 56 respectively as well as act as a supporting plane for the respective bumps they exist in.

Sub-Heading 1c2

Water Receiving Perforated Wells

Referring again to FIG. 3*a*, as previously described: partial ellipse 27*e* extends downward into plane 27 which further extends at a 90 degree angle into plane 30. As a profiled illustration, plane 30 has an approximate length of 0.154 inch. Plane 30 is perforated, as is illustrated in FIG. 4:70 with elliptical perforations approximately 0.09 in wide, 0.38 inches long, and spaced longitudinally at approximately 0.15 inch intervals. Plane 30 extends upward at an approximate 90 degree right angle into plane 31. Plane 31 parallels plane 27 and has an approximate length of 0.045 inch. Plane 31 extends upward into partially ellipsed plane 31*e*. Partially ellipsed plane 31*e* has an approximate partial circumference of 0.03 inch. partial ellipse 27*e*, plane 27, plane 30, plane 31, and partial ellipse 31*e* jointly form perforated well 32.

Wells 39, 49, and 52 existent in the multi-level water receiving well of the present invention have measurements identical to well 32 of the present invention. The dimensions of wells 22 and 24 have been previously described in this disclosure.

Referring again to FIG. 2:23*ev*, wells 46 and 57 incorporate two downward extending planes or channels 44 and 56 respectively which differentiates them from other perforated wells existent in the present invention. Wells 46 and 57 have identical measurements as do their respective channels 41*c* and 55*c*.

Well 46 is jointly formed by ellipse 43*e*, plane 41, circumference 41*c*, plane 41*d*, plane 45, plane 45*a* and partial ellipse 45*e*. Partial Ellipse 43*e* has an approximate partial circumference of 0.03 inch and extends downward into plane 41 which parallels plane 38. Plane 41 has an approximate length of 0.28 inch and extends into circumference 41*c*. Circumference 41*c* has an approximate outside diameter of 0.06 inch. Circumference 41*c* extends upward into plane 41*d*. Plane 41*d* has an approximate length of 0.23 inch. Plane 41*d* extends into or joins plane 45 at an approximate 90 degree angle. Plane 45 has an approximate length of 0.13 inch. Plane 45 extends upward into partial ellipse 45*e* which has an approximate partial circumference of 0.03 inch. As mentioned earlier, well 57 has measurements identical to those of well 46.

Plane 41, circumference 41*c*, and plane 41*d* within well 46 additionally jointly form channel 44 which has an approximate height 43*h* of 0.24 inch and an approximate width 44*w* of 0.03 inch. As mentioned earlier, channel 55*c* within well 57 has measurements identical to those of channel 44.

Referring again to FIG. 2:23*ev*, 59*d* has an approximate length of 0.045 inch and extends into plane 60*a*. 60*a* has an approximate length of 0.154 inch and extends upward at an approximate 90 degree angle into plane 61. Plane 61 has an approximate length of 0.045 inch. Plane 59*d*, plane 60*a* and plane 61 jointly form perforated well 60.

Sub-Heading 1d

Second Filtration Membrane Receiving Channel

Referring again to FIG. 2, plane 61 extends at an approximate 90 degree angle into plane 62 which serves as the bottom shelf of receiving channel 65 and has an approximate length of 0.44 inch. Plane 62 extends upward into partial circumference 63 which has an approximate outside diameter of 0.05 inch. Partial circumference 63 extends into plane 64 which serves as the top shelf of receiving channel 65 and has an approximate length of 0.4 inch. Plane 62, partial circumference 63, and plane 64 jointly form the second receiving channel of the present invention which serves to receive and secure a lateral edge of the filtration membrane 71 as illustrated in FIG. 6.

Sub-Heading 1e

Rear Shelf

Plane 64 extends upward into partial circumference 66. Partial circumference 66 has an approximate outside diameter of 0.05 inch and extends rearward into plane 66. Plane 66 has an approximate length of 1.55 inch. 66 extends downward into partial circumference 67 which has an approximate outside diameter of 0.06 inch. Partial circumference 67 extends into plane 68 which has an approximate length of 0.11 inch.

Sub-Heading 2

Metallic Cloth Filtration Membrane

Referring to FIGS. 5 and 5*a*, there is illustrated in 71 a metallic filtering membrane composed of stainless steel threads. This filtering membrane is commonly referred to as "wire cloth" and is presently employed as a screening debris filter in the manufacture of plastics and as a filtering component of industrial mufflers. The diameter of metallic threads may range from 10 to 30 mm and be crimp woven in meshes from 100 to 150 mesh (thread counts per inch).

Referring to FIG. 5 it is illustrated that the filtering cloth 71 has its lateral edges folded over or hemmed 71*a* to eliminate sharp cutting edges often noted in wire cloth.

Referring to FIG. 6 it is illustrated that filtering cloth 71 is inserted into the body of the present invention and held in place by channels 22 and 65. In the field it has been noted that filtering cloth 71 will not be dislodged by wind due to the natural stiffness present in wire cloths of 120 mesh or less.

Operation of the Main Embodiment

Flow Screen

Referring to FIG. 6, there is illustrated the present invention: a gutter protection system that consists of a main body 69 with integral filtration membrane receiving channels 22 and 65 enveloping the lateral edges of an insertable filtration membrane 71 that overlies a multi level supporting skeleton of perforated planes, non perforated planes, upward extending nodes and downward extending planes collectively noted as 23*ev*.

The main body, 69, of the present invention is presently manufactured and marketed as an extruded polymer: Leaf-filter RTM, and the body is presently manufactured as roll formed aluminum product: Flow Screen RTM. presently in a testing stage and not yet offered for sale as of the time of this patent application. 69, as a polymer body is composed of poly vinyl chloride (PVC) that is reduced to liquid form through screw compression of PVC "tags". This liquid plastic mixture is then extruded through a profile forming die, then through a cooling tray and cut to 5 foot lengths. This length has proven ideal for installation by one individual in that its length is short enough to be readily handled and accessed while allowing for as few joints or seams as possible to exist between adjoining body members of the present invention when it is installed over the length of a rain gutter. The extruded material is rigid and has a thickness of approximately 0.06 inch. The extruded material has proven, in the field, to be suitably thick to maintain its shape and not deform or dip under load bearing weight of snow and ice or deform when exposed to high ambient temperatures which have caused prior art of lesser thickness to deform vertically upwards and downwards allowing open-air gaps to form from one piece op prior art to the next when the rest abutted side by side. These gaps may allow debris entrance into a gutter.

Referring to FIG. 7, the present invention is illustrated as inserted into the top water receiving opening of a k-style rain gutter 72 and resting on the front top lip 73 of the k-style rain gutter and resting on a sub-roof 68 of a building structure. The present invention is secured to the underlying rain gutter 75 by the encompassing of the front top lip 73 of the rain gutter by planes 3, 5, and 6 of the present invention and further secured by the insertion of plane 66 of the present invention beneath roof shingles 74.

Sub-Heading 1

Water Receiving Area of the Main Body

Once this is accomplished, main body 69 offers improvement over prior art as follows: As noted in U.S. Pat. No. 6,598,352: "Perforated surfaces existing in a single plane, such as are employed in U.S. Pat. No. 5,595,027 to Vail, or as exists in the Commercial Product SHEERFLOW.RTM. manufactured by L.B. Plastics of N.C., and similar prior art tend to channel water past perforations rather than down through them and into an underlying rain gutter. Prior art sought to correct this undesirable property by either tapering the rim of the open perforation and/or creating downward extensions of the perforation (creating a water channeling path down through open air space) as exhibited in prior art U.S. Pat. No. 6,151,837 to Ealer, or by creating dams on the plane the perforations exist on, as exhibited in prior art U.S. Pat. No. 4,727,689 to Bosler. Such prior art has been unable to ensure all water would channel into the underlying rain gutter because the water, that did indeed, travel through the open apertures on the top surfaces of these types of perforated planes or screens, would also travel along the underside of the screen wires or perforated planes, as it had on top of these surfaces, and still continue it's undesirable flow to the front of the invention and front lip of the underlying rain gutter, due to water adhesion. Additionally, this "underflow" of water on the underside of the perforated planes and screens illustrated in prior art exhibits a tendency to "backflow" or attempt to flow upwards through the perforations inhibiting downward flow of water. This phenomenon has been noted in practice, in the field when it has been observed that open air apertures appear filled with water while accomplishing no downward flow of water into the underlying rain gutter.

Other inventors sought to eliminate this undesirable property by employing linear rods with complete open air space existing between each rod, this method of channeling more of the water into the rain gutter exhibits greater success on the top surface of such inventions, but it fails to eliminate the "under channeling" of rainwater toward the front of the invention due to the propensity of water to follow the unbroken interconnected supporting rods or structure beneath the top layer of rods."

I was able to accomplish significant improvement over prior art by employing a filter skeleton, illustrated in FIG. 3 of my U.S. Pat. No. 6,598,352, which incorporates ellipsed top members resting on upward extending planes adjoined to an underlying perforated planes. The upward extending planes of this filter skeleton contact the underside of a micromesh cloth composed of threads that are separated by no more than 120 microns of open airspace between threads and, at the point of plane and cloth contact, water has been noted to cease forward flow and redirect into significant downward flow of water into an underlying rain gutter. FIG. 8 of my U.S. Pat. No. 6,598,352 illustrates the filter skeleton and adjoined fine filtration cloth join and form separate member from the main body of the invention that is inserted into the main body of the invention. This unique configuration of fine filtration cloth and filter skeleton inserted into a recessed perforated well has been observed in practice, in the field over a two year period, to completely disallow the clogging of a rain gutter and to allow known clogging or moss overgrowth of the fine filtration cloth and skeleton combination in fewer than 10 product installations out of thousands of known installations. My U.S. Pat. No. 6,598,352 has been marketed the past two years as "Leaffilter RTM".

Sub-Heading 1a

Upward Raised Planes and Perforations

During this period of practice in the field several improvements were made to U.S. Pat. No. 6,598,352 to ease its installation and lower its cost of manufacture and shipping. Most notably, in June of 2003 I redesigned the main body of my prior art found in U.S. Pat. No. 6,598,352 to incorporate the upward extending planes found in it's insertable filter skeleton directly into the perforated recessed well of the main body. This has been accomplished in both an extruded polymer main body and in a roll formed aluminum body of the present invention: This significantly improves ease of installation in that the present embodiment of "Leaffilter RTM" no longer employs an insertable polymer filter skeleton that was extruded in 50 foot lengths rolled into rolls approximately two feet in diameter and weighing approximately 9 lbs. These were discovered to be difficult to install due to the size and weight of the insertable filtration member and noted to significantly stiffen as field temperatures cool below approximately 40 degrees. Additionally, the insertable polymer filter skeleton illustrated in FIG. 6 of my U.S. Pat. No. 6,598,352 required transportation to a sewing converter which accomplished unrolling and re-rolling of the polymer filtration skeleton as polymer filtration cloth was sewn to the base of the skeleton. This action required additional shipping costs as well.

Referring to FIG. 3, there is illustrated a multi level supporting skeleton comprised of perforated plane 17 (existing beneath plane 11), non perforated planes 18, 20, 21, and, referring to FIG. 4, comprised of perforated planes 25, 32, 39, 49, 52, 60, and comprised of non perforated planes 46 and 57, and comprised of upward extending "bumps" 29, 36, 43, 48, 51, 54, 59, and comprised of non perforated planes 39 and 49 which are adjoined by downward extending channels 38 and 48 collectively. This multi level support skeleton is referred to, collectively, as 23*ev*. Incorporating the upward extending planes and perforated wells found in the flexible insertable filter skeleton of my prior art into the main body of the present invention, in the above described manner, achieves the same water directing properties by means of water adhesion and water pressure (due to water volume existent in said wells) found in my prior art and does so utilizing less material resulting in a lower cost of manufacture while additionally eliminating a separate insertable member subject to stiffening during cold weather installations.

Sub-Heading 1b

Filtration Membrane

It was also discovered during this period of practice (installing the Leaffilter RTM gutter cover in the field over a period of two years) that the warp-knit polymer fabric employed as a filtration membrane sewn to an underlying insertable filtration skeleton, illustrated in FIGS. 5 and 6 of my U.S. Pat. No. 6,598,352, succumbed to UV exposure deterioration over a period of time regardless of the amount of UV inhibitors employed. This may have been due to the small denier of polymer threads that constituted the polymer fabric. Significant improvement is accomplished in the present invention in substituting a woven stainless steel micro mesh cloth as is illustrated in FIG. 6 of the present invention. In the prior art of U.S. Pat. No. 6,598,352 it is disclosed that threads that adjoin or intersect one another are less subject to debris lodging between threads and tend to present less resistance to downward water flow than does woven or knitted micromesh cloths: both intersecting threads of dissimilar deniers and adjoining threads of similar deniers have been noted to exhibit desirable debris repellant and water permeability features to a greater degree than is found in typical woven or knitted micromesh fabric. However, there is presently no known technology able to mass produce warp-knit cloth utilizing metallic threads. It has been noted in field installations of the present invention, accomplished over a period of approximately one year, that woven stainless steel threads exhibit water permeability that approaches that found in the polymer warp-knit micro mesh fabric utilized in my prior art, provided that the wire diameter of the woven stainless steel threads does not exceed 10 mm, the thread count does not exceed 100×100, and the wires are crimped or pressed at their point of weave or contact so that the combined height of two threads is lessened at the point that one thread weaves over or under another. In testing, it has been further discovered that the same debris shedding properties are present in configurations of wire cloth that employ "crimped weaves" whereby pressure is applied at the point of weave contact between threads. This crimping of metallic threads at their point of contact places threads in more of a linear plane in relation to one another which allows the cloth to shed rather than trap debris. As disclosed in U.S. Pat. No. 6,598,352, the greater the vertical height between threads at their point of contact, the more likely it is that debris will be trapped and held rather than shed.

The present invention utilizes woven wire cloth exclusively as it has been discovered that such cloth, even as a woven cloth, exhibits less shifting of threads and less height differential between threads as well as providing a filtering membrane less susceptible to decay in comparison to polymer or natural "warp-knit" fabrics. FIGS. 5 and 5*a*, of the present invention illustrate a stainless steel wire cloth 71 of not less than 100×100 thread count, crimp woven.

Referring now to FIG. 6, the illustrated micro mesh stainless steel wire cloth serves as an insertable filtration membrane 71 not subject to stiffening as field temperatures cool and has been noted, in the field, to be more easily handled in any temperature as it is much lighter and far less bulky than the filtration skeleton covered with attached polymer micromesh cloth that served as the insertable filtration member found in my prior art illustrated in FIGS. 5 and 6 of my U.S. Pat. No. 6,598,352.

FIG. 5: 71 of the present invention illustrates that the lateral edges 71 a of the stainless steel filtration membrane are hemmed. This is presently accomplished by passing 120 foot lengths of stainless steel cloth, slit to 4 inches width, though a roll former that hems the lateral edges of the stainless steel cloth and re-rolls its entire length into an easily handled roll approximately 4 inches in diameter and weighing less than 1.5 lbs. The manufacture and packaging of the stainless steel filtration member eliminates a shipping step necessary in manufacturing and packaging the polymer filtration skeleton used in my prior art and allows the filtration member of the present invention to be packaged in the same box that holds 5 foot lengths of the main body: the polymer filtration skeleton disclosed in my prior art formerly utilized in the Leaffilter RTM product was boxed separately from the main body of disclosed in my prior art and utilized in the Leaffilter RTM product. Hemming the stainless steel filtration membrane 5:71 of the present invention provides a dull edge unlikely to cause cuts as filtration member is handled in the field prior to and during installation.

Sub-Heading 1b

Installation of Filtration Member

Once installation of the main body 69 is installed into the top open area of a k-style rain gutter 72 as illustrated in FIG. 7. Referring now to FIG. 6; installation of the stainless steel filtration member is accomplished by grasping the leading edge of a roll of the filtration member and pulling it through channels 22 and 65 of the main body 69 of the present invention. Referring again to FIG. 7; once this final step of installation is accomplished, rain water will flow off roof member 74 through stainless steel micro mesh filtration member 71 contacting upraised "bumps", such as 48 and 51, and being diverted downward by these planes down through perforations 70 into an underlying rain gutter 72. The present invention thereby provides a more economical and more readily installed gutter protection method than Leaffilter RTM. offers while proving equally capable of preventing debris as small as 100 microns from entering a rain gutter while ensuring nearly 100% of rain water run off from roof members enters underlying gutters as has been noted in the field.

Sub-Heading 2

Material and Manufacturing Process

It is important to note that the dimensions listed in the Description of the Preferred Embodiment of this present invention are descriptive of the present invention as it currently has been manufactured for 11 months in a polymer embodiment that is different in several respects (disclosed in this application) from its original manufactured embodiment that closely resembled the preferred embodiment illustrated in my U.S. Pat. No. 6,598,352. Additionally, a roll-formed metallic prototype of the present invention employing smaller thinner "bumps" and shallower perforated "wells" has demonstrated that the operation of the present invention; specifically its ability to break the forward flow of water that occurs over flat perforated planes and direct it downward, varies little providing that the height of "bumps" does not fall below 0.06 inch. and provided the dimensions of perforations 70 have a minimum length of 0.25 inch and a minimum width of 0.15 inch and are spaced longitudinally at a distance no greater than 0.18 inch. Smaller perforations spaced further apart proved insufficient at draining large amounts of water into an underlying rain gutter.

In summary, a critical element described in claim one of technology described in my U.S. Pat. No. 6,598,352 (under which the Leaffilter RTM is manufactured) is the utilization of upraised planes rising from and forming the sides of perforated wells. These underlying planes contact the underside of a filtration cloth and break the forward flow of water and direct it downward into an underlying rain gutter. This technology of "upraised planes" breaking the forward flow of water and directing it downward, described in my U.S. Pat. No. 6,598,352, has been demonstrated to remain effective through subsequent alternate embodiments described in this present invention that have unified separate elements and varied the height and the width and positioning of the upraised planes resulting in a more easily installed and economically manufactured product. The process of roll-forming metal disallows exact duplication of shapes and dimensions possible in extrusion of polymers. Extensive testing and redesign of an alternate metallic roll formed embodiment of the Leaffilter RTM product has disclosed that some further alterations of the dimension and position of water directing planes disclosed as the Preferred Embodiment of this present invention can be accomplished. resulting in a more easily installed and economically manufactured product.

Description of Alternate Embodiments

Referring to FIG. 8 there is illustrated an alternate embodiment of the present invention: 44*tc* which is a triangular shaped channel that will receive a triangular shaped joining member FIG. 9: 76. Sides 44× and 44*z* have approximate lengths of 0.23 inch. and side 44*y* has an approximate length of 0.28 inch. Triangular shaped joining member 76 has equilateral sides with approximate lengths 76*a*, 76*b*, 76*b*, of 0.21 inch.

It has been noted in the field that after installation of the present invention into a rain gutter, a variance in height between adjoining main bodies 69 of the present invention may occur. This alternate embodiment serves to lock main bodies 69 into the same horizontal plane preventing any debris entrance into a rain gutter occurring through open air spaces that may occur if adjoining main bodies 69 rise or fall above or beneath one another. FIG. 11 further illustrates that joining member 76 inserts partially into the triangular shaped channel of a main body 69*a* allowing an adjoining main body 69*b* to be slid into place allowing its triangular shaped channel to encompass a remaining portion of joining member 76.

Referring again to FIG. 8: 77*tc*, it is illustrated that a triangular channel may also be employed at the front most portion of the main body 69 of the present invention to serve as a means of receiving joining members.

Operation of an Alternate Embodiment

Flow Screen

Referring to FIG. 8: 44×, 44*y*, 44*z*, there is illustrated a downward extending triangular shaped channel 44*tc*. This alteration of the downward extending channel illustrated in FIG. 2: 44 allows for the insertion of an extruded polymer or roll formed metallic triangular shaped joining member FIG. 9: 76 to be inserted into two adjoining main bodies 69*a* and 69*b* of the present invention, as illustrated in FIG. 11, allowing the main bodies to abutted against each other and held at a consistent level prohibiting one main body from rising above or falling beneath the profile of previous or subsequent main body members it may be abutted against.

REFERENCE NUMERALS IN DRAWING

1. plane 1, length: approximately 0.11 inch
2. circumference 2, outside diameter approximately 0.06 inch
3. plane 3, length approximately 0.53 inch.
4. angle 4, approximately 60 degrees.
5. plane 5, length approximately 0.5 inch.
6. plane 6, length approximately 0.35 inch
7. circumference 7, when the present invention is in a metallic roll formed state, outside diameter approximately 0.06 inch termination point 7, when the present invention is in a polymer extruded state
8. plane 8, length approximately 0.42 inch
9. channel 9, when the present invention is in a metallic roll formed state, with an open air space of approximately 0.022 inch
10. angle 10, approximately 60 degrees
11. plane 11, length approximately 0.44 inch
12. circumference 12, when the present invention is in a metallic roll formed state, outside diameter approximately 0.06 inch termination point 12, when the present invention is in a polymer state
13. Plane 13, has an approximate length of 0.44 inch
14. circumference 14, has an approximate outside diameter of 0.075 inch
15. plane 15, length approximately 0.17 inch
16. plane 16, length approximately 0.045 inch
17. plane 17, length approximately 0.157 inch
18. plane 18, length approximately 0.045 inch
19. perforated well
20. plane 20, length approximately 0.10 inch
21. plane 21, length approximately 0.045 inch
22. receiving channel 22
22*w*. width: 0.48 inch of channel 22
22*h*. height: 0.056 inch of channel 22
23. plane 23, length of approximately 0.154 inch
23*ev*. multi-level water receiving area of the present invention
24. plane 24, length of approximately 0.045 inch
24*e*. partial ellipse, with a partial circumference of approximately 0.03 inch
25. perforated well
25*w* interior width: of perforated well 25: 0.15 inch measured from plane 21 to plane
25*h*. interior height: 0.06 of perforated well 25
26. plane 26, length approximately 0.070 inch measured from partial ellipse 24*e* to partial ellipse 27*e*
27. plane 27, length approximately 0.045 inch
28. ellipsed cap 28, length approximately 0.16 inch
29. bump, a supportive and water directing plane
29*w*. interior width: 0.13 inch of bump 29 measured from plane 24 to plane 27
29*h*. height: 0.068 inch of bump 29
30. plane 30, length approximately 0.154 inch
31. plane 31, length approximately 0.045 inch
31*e* partial ellipse, with a partial circumference of approximately 0.03 inch
32. perforated well
32*w*. interior width: of perforated well 32: 0.15 inch measured from plane 27 to plane 31
32*h*. interior height: 0.06 inch of perforated well 32
33. plane 33, length approximately 0.070 measured from partial ellipse 31*e* to partial ellipse 34*e*
34. plane 34, length approximately 0.045 inch
34*e*. partial ellipse, with a partial circumference of approximately 0.03 inch
35. ellipsed cap 35, length approximately 0.16 inch
36. bump, a supportive and water directing plane
36*h* height: 0.068 inch of bump 36
37. plane 37, length approximately 0.154 inch
38. plane 38, length approximately 0.045 inch
39. perforated well
39*h*. interior height: 0.06 inch of perforated well 39
39*w*. interior width: of perforated well 39: 0.15 inch measured from plane 34 to plane 38
40. plane 40, length approximately 0.070 measured from partial ellipse 38*e* to partial ellipse 41*e*
41. plane 41, length approximately 0.28 inch
41*c*. circumference 41*c*, approximate outside diameter 0.06 inch
41*d*. plane 41*d*, length approximately 0.23 inch
42. ellipsed cap 42, length approximately 0.16 inch
43. bump, a supportive and water directing plane
43*h*. height: 0.33 inch of channel 44
44. channel 44
44*w* width: 0.03 inch of channel 44
44*tc*. alternate triangular shaped embodiment of channel 44
44*x*. side 44*x* approximate length 0.23 inch
44*y*. side 44*y* approximate length 0.28 inch
44*z*. side 44*z* approximate length 0.23 inch
45. plane 45, length approximately 0.13 inch
46. non-perforated well
46*h*. interior height: 0.06 inch of non-perforated well 46
46*w*. interior width: of on-perforated well 46: 0.15 inch measured from plane 41 to bump 48
47. ellipsed cap 47, length approximately 0.16 inch
48. bump, a supportive and water directing plane
49. perforated well
50. ellipsed cap 50, length approximately 0.16 inch
51. bump, a supportive and water directing plane
52. perforated well
53. ellipsed cap 53, length approximately 0.16 inch
54. bump, a supportive and water directing plane
55. plane 55, length approximately 0.28 inch
55*c*. circumference 55, approximate outside diameter 0.06 inch

55*d*. plane 55*d*, length approximately 0.23 inch
56. channel 56
57. non-perforated well
58. ellipsed cap 58, length approximately 0.16 inch
59. bump, a supportive and water directing plane
60. perforated well
61. plane 61, length approximately 0.045 inch
62. plane 62, length approximately 0.44 inch
63. circumference 63, approximate outside diameter 0.06 inch
64. plane 64, length approximately 0.4 inch
65. channel 65
66. plane 66, length approximately 1.5 inch
67. circumference 63, approximate outside diameter 0.06 inch
68. plane 68, length approximately 1.5 inch
69. main body
70. perforations
71. metallic cloth filtration membrane
72. k-style rain gutter
73. top lip of k-style rain gutter
74. roof membrane
75. sub roof
76. joining member
76*a*. side 76*a* approximate length 0.21 inch
76*b*. side 76*b* approximate length 0.21 inch
76*c*. side 76*c* approximate length 0.21 inch
M1(3). main plane 1, only illustrated as such in FIG. 1 for the purpose of illustrating one of five major interconnecting planes of the present invention, illustrated as plane 3 otherwise
M2(5). main plane 2, only illustrated as such in FIG. 1 for the purpose of illustrating one of five major interconnecting planes of the present invention, illustrated as plane 5 otherwise
M3(11). main plane 3, only illustrated as such in FIG. 1 for the purpose of illustrating one of five major interconnecting planes of the present invention, illustrated as plane 11 otherwise M4(23*ev*). main plane 4, only illustrated as such in FIG. 1 for the purpose of illustrating one of five major interconnecting planes of the present invention, illustrated as plane 23*ev* other wise. M5(66). main plane 5, only illustrated as such in FIG. 1 for the purpose of illustrating one of five major interconnecting planes of the present invention, illustrated as plane 66 otherwise.

I claim:

1. A gutter shield device for mounting in an open top of a rain gutter attached to an edge of a roof, said gutter shield comprising:

an elongated body of extruded or roll formed material, the elongated body having a plurality of interconnected planes including a first plane;

a second plane connected to the first plane and extending at an angle therefrom;

first leg connected to the second plane and extending at an angle therefrom, wherein the first plane, the second plane, and the first leg define a front fastening member configured to receive the lip of the rain gutter;

a third plane connected to the first leg;

perforated fourth plane connected to the third plane by a first u-shaped receiving channel and extending substantially parallel to the third plane, said perforated fourth plane including a plurality of spaced bumps extending in a first direction from said perforated fourth plane for supporting and contacting filtration element, wherein said plurality of bumps define a plurality of spaced wells, said perforated fourth plane further having at least one substantially perpendicular second leg extending therefrom in a second direction, the second direction being substantially opposite the first direction; and a fifth plane connected to said fourth plane by a second u-shaped receiving channel and extending substantially parallel to said perforated fourth plane.

2. The gutter shield device according to claim 1, wherein said plurality of spaced bumps extend in said first direction from said perforated fourth plane at least 0.04 inches.

3. The gutter shield device according to claim 1, wherein said plurality of spaced bumps are spaced from one another at a distance equal to or less than six times their height in said first direction.

4. The gutter shield device according to claim 1, wherein said filtration element is secured at its lateral edges in said first and second u-shaped receiving channels, and wherein at least one of said plurality of spaced bumps supports and contacts said filtration element.

5. The gutter shield device according to claim 4, wherein said filtration element is comprised of a plurality of crimp woven metallic threads having a thread count of not less than 100 threads per inch.

6. The gutter shield device according to claim 1, wherein said at least one substantially perpendicular second leg extending from said perforated fourth plane has a height in said second direction of not less than 0.25 inches.

7. The gutter shield device according to claim 1, wherein said at least one substantially perpendicular second leg extending from said perforated fourth plane is one of a u-shaped channel or a solid planar leg.

8. The gutter shield device according to claim 1, wherein said first leg connected to the second plane is one of a u-shaped channel or a solid planar leg.

9. A gutter shield device for mounting to a rain gutter attached to a building structure, the gutter shield device comprising:

an elongated body comprising:

a first body portion;

a second body portion; and an intermediate body portion disposed between the first and second body portions and connected to the first and second body portions by a first receiving channel and a second receiving channel, respectively, wherein the intermediate body portion includes:

a plurality of elongated protruding elements extending in a first direction; and a plurality of recessed wells, at least one of the plurality of recessed wells having an opening in a bottom surface thereof and each of the plurality of recessed wells being disposed between consecutive protruding elements; and a filter element having a first lateral edge received in the first receiving channel and a second lateral edge received in the second receiving channel, wherein at least one of the plurality of protruding elements contacts a surface of the filter element.

10. The gutter shield device according to claim 9, wherein the intermediate body portion further comprises at least one leg extending in a second direction and having a free end, the second direction being substantially opposite to the first direction.

11. The gutter shield device according to claim 9, wherein the first lateral edge of the filter element does not touch an inner end surface of the first receiving channel.

12. The gutter shield device according to claim 9, wherein the first and second receiving channels are u-shaped.

13. A body of a gutter shield device for mounting to a rain gutter attached to a building structure, the body of the gutter shield device comprising:

a first body portion;

a second body portion; and an intermediate body portion connected to the first and second body portions via a first receiving channel and a second receiving channel, respectively, the first and second receiving channels being adapted to hold lateral edges of a filter element therein, the intermediate body portion including a plurality of protruding elements extending in a first direction, the plurality of protruding elements being adapted to contact a surface of the filter element; and a plurality of recessed wells having an opening in a bottom surface thereof, each of the plurality of recessed wells being disposed between consecutive protruding elements.

14. The body according to claim 13, wherein the intermediate body portion further includes at least one leg extending in a second direction and having a free end, the second direction being substantially opposite to the first direction.

15. The gutter shield device according to claim 13, wherein the first and second receiving channels are u-shaped.

* * * * *